US010526737B2

(12) United States Patent
Han et al.

(10) Patent No.: US 10,526,737 B2
(45) Date of Patent: Jan. 7, 2020

(54) LAUNDRY TREATMENT APPARATUS

(71) Applicant: LG Electronics Inc., Seoul (KR)

(72) Inventors: Seungwoo Han, Seoul (KR); Doohyun Kim, Seoul (KR); Geunhyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 15/579,098

(22) PCT Filed: Jun. 2, 2016

(86) PCT No.: PCT/KR2016/005859
§ 371 (c)(1),
(2) Date: Dec. 1, 2017

(87) PCT Pub. No.: WO2016/195398
PCT Pub. Date: Dec. 8, 2016

(65) Prior Publication Data

US 2018/0171523 A1 Jun. 21, 2018

(30) Foreign Application Priority Data

Jun. 3, 2015 (KR) ..... 10-2015-0078811

(51) Int. Cl.
*D06F 25/00* (2006.01)
*D06F 58/20* (2006.01)
(Continued)

(52) U.S. Cl.
CPC ..... *D06F 25/00* (2013.01); *D06F 39/083* (2013.01); *D06F 58/20* (2013.01); *D06F 58/24* (2013.01)

(58) Field of Classification Search
CPC ..... B08B 9/093
See application file for complete search history.

(56) References Cited

U.S. PATENT DOCUMENTS

2009/0007601 A1 1/2009 Suzuki et al.
2014/0157833 A1 6/2014 Hong et al.
(Continued)

FOREIGN PATENT DOCUMENTS

JP 2010082357 4/2010
JP 2011010987 1/2011
KR 1020150026548 3/2015

OTHER PUBLICATIONS

PCT International Search Report in International Appln. No. PCT/KR2016/005859, dated Sep. 12, 2016, 4 pages.
(Continued)

*Primary Examiner* — Jason Y Ko
(74) *Attorney, Agent, or Firm* — Fish & Richardson P.C.

(57) ABSTRACT

Disclosed is a laundry treatment apparatus equipped with an exhaust type drying system, which is capable of not only enhancing drying efficiency while reducing consumption of energy and cooling water required to dry laundry, but also achieving smooth exhaust of air even when a water trap is formed in a drainage duct. The laundry treatment apparatus includes a casing, an outer tub, an inner tub, a drainage duct for guiding wash water stored in the outer tub to be discharged to the outside of the casing, a first exhaust duct connected, at one end thereof, to the drainage duct, to guide air present in the outer tub into the drainage duct, and a second exhaust duct upwardly branched from the drainage duct, to exhaust air present in the drainage duct to the outside of the outer tub or the outside of the cashing.

17 Claims, 4 Drawing Sheets

(51) Int. Cl.
*D06F 39/08* (2006.01)
*D06F 58/24* (2006.01)

(56) References Cited

U.S. PATENT DOCUMENTS

2014/0173847 A1 6/2014 Nguyen
2015/0059413 A1 3/2015 Yoo et al.

OTHER PUBLICATIONS

European Search Report in European Appln. No. 16803753.9, dated Nov. 9, 2018, 7 pages.

[Fig. 1]
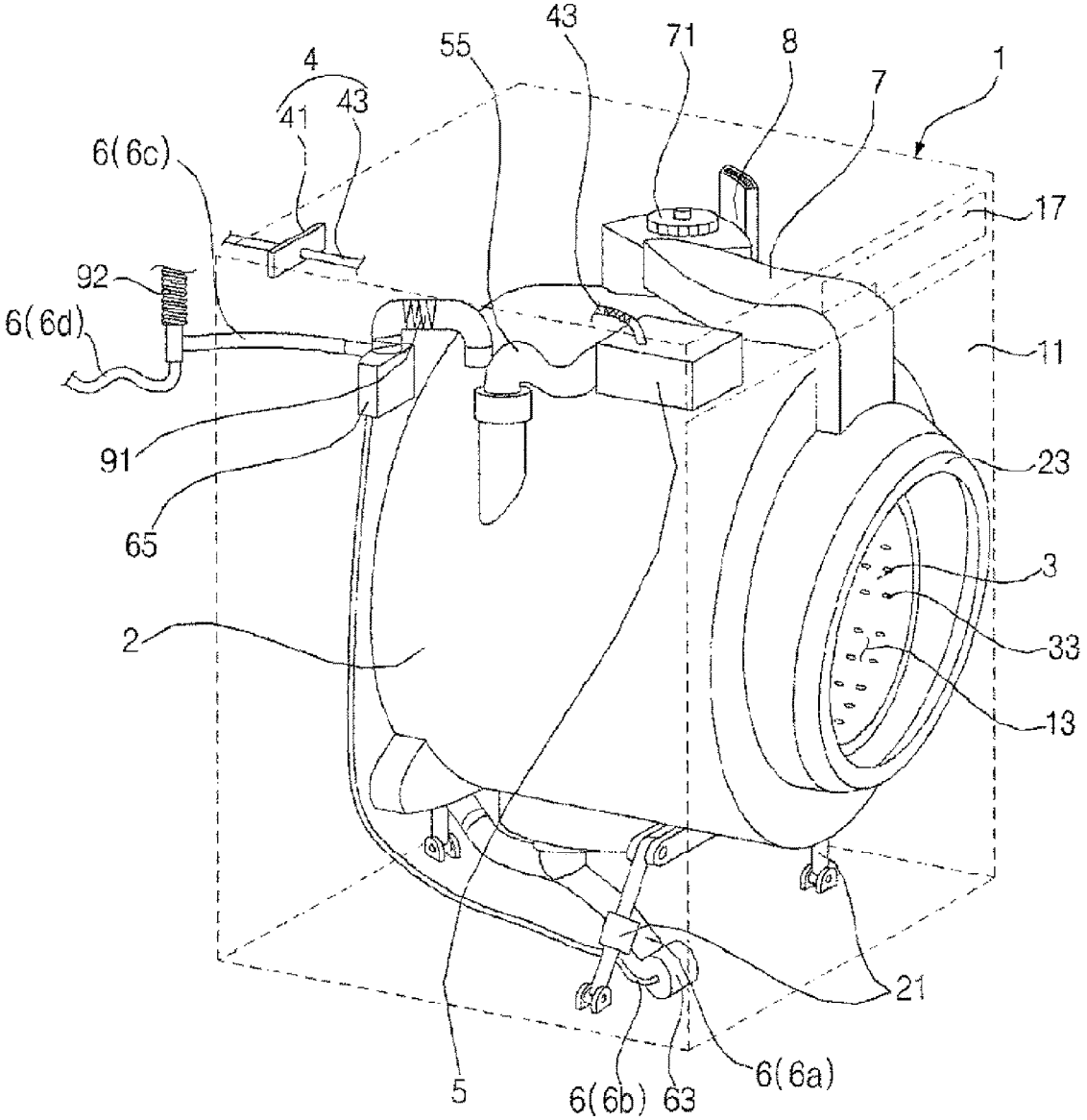

[Fig. 2]
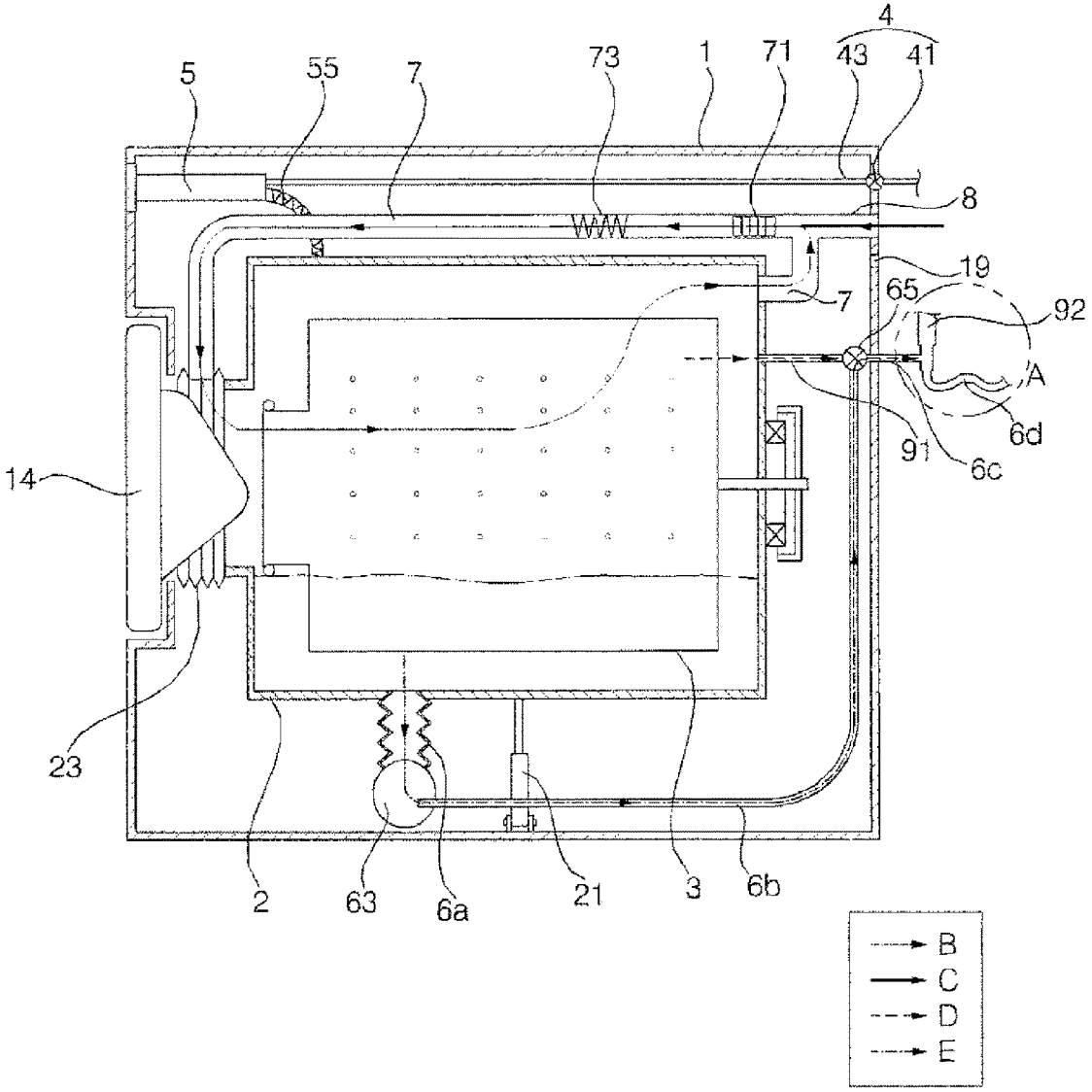

[Fig. 3]
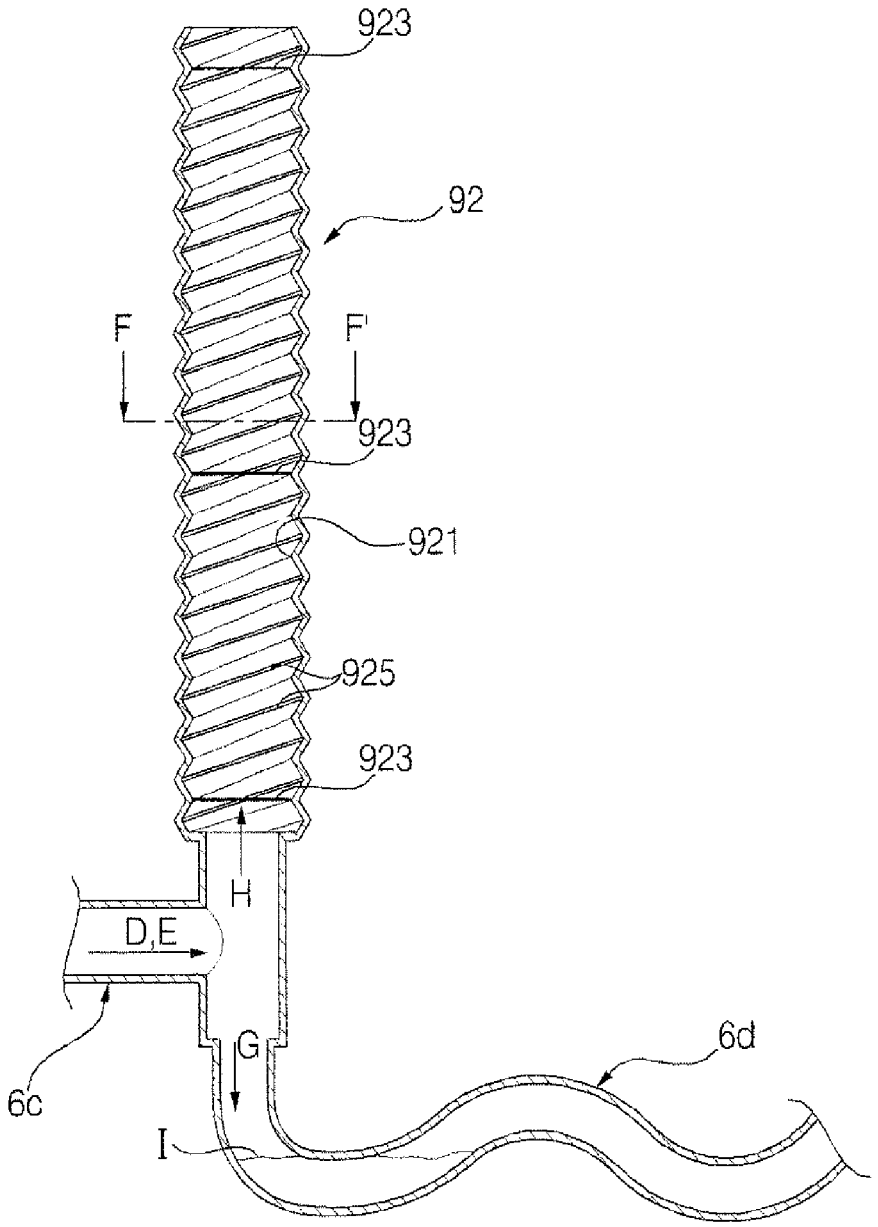

[Fig. 4]
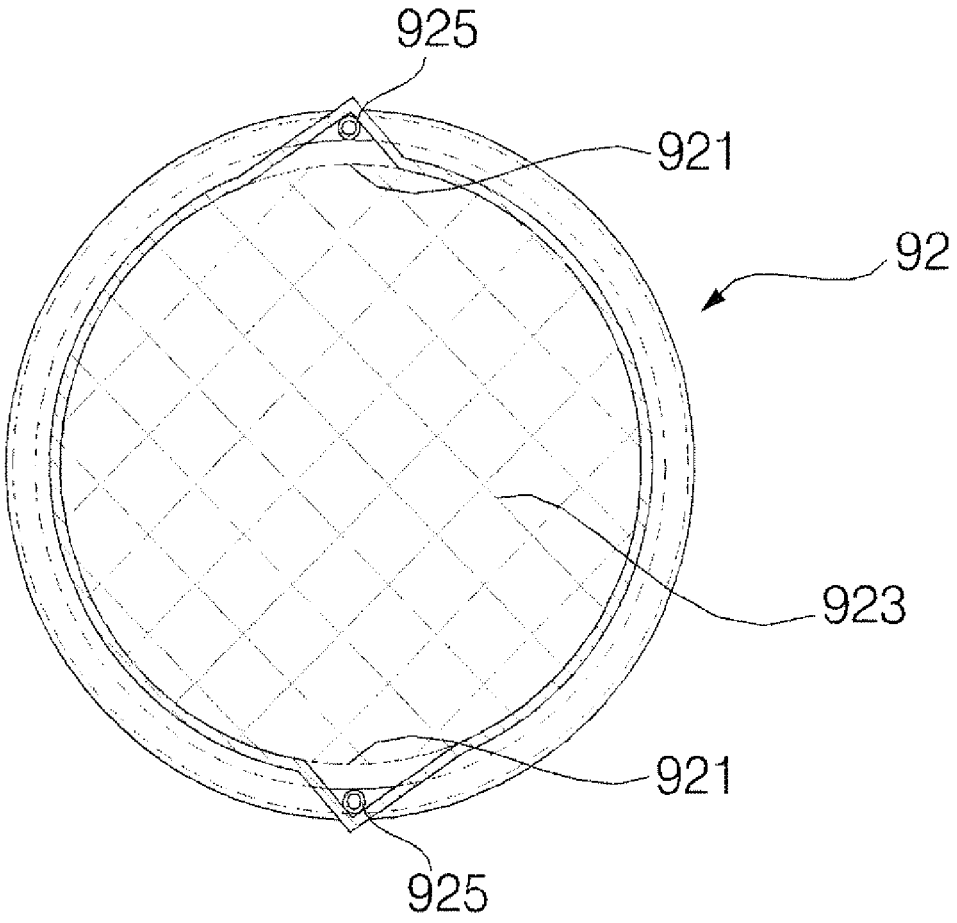

LAUNDRY TREATMENT APPARATUS

CROSS-REFERENCE TO RELATED APPLICATIONS

This application is a National Stage application under 35 U.S.C. § 371 of International Application No. PCT /KR-2016/005859, filed Jun. 2, 2016, which claims the benefit of Korean Application No. 10-2015-0078811, filed on Jun. 3, 2015. The disclosures of the prior applications are incorporated by reference in their entirety.

TECHNICAL FIELD

The present invention relates to a laundry treatment apparatus, and more particularly to a laundry treatment apparatus equipped with an exhaust type drying system.

BACKGROUND ART

Laundry treatment apparatuses, which can dry laundry, are classified into a laundry treatment apparatus equipped with an exhaust type drying system and a laundry treatment apparatus equipped with a circulation type drying system in accordance with how air supplied to laundry is treated after exchanging heat with the laundry.

In the case of the circulation type drying system, there may be a drawback in that cooling water should be supplied for dehumidification of air re-supplied to an outer tub after being discharged from the outer tub and, as such, a great amount of cooling water is consumed. On the other hand, in the case of the exhaust type drying system, there may be a drawback in that air having exchanged heat with laundry is exhausted to the outside even though the temperature of the air is higher than that of outside air and, as such, a great amount of energy is consumed to dry laundry.

In order to solve such problems, a laundry treatment apparatus equipped with a hybrid system has been proposed. In the hybrid system, air present in an outer tub is partially exhausted, and the remaining air is re-supplied to the outer tube through circulation.

The laundry treatment apparatus equipped with the hybrid system includes an exhaust duct for partially exhausting air discharged from the outer tub. When air is directly exhausted through the exhaust duct, there may be a problem in that a great amount of water vapor may be produced around the laundry treatment apparatus. On the other hand, when the exhaust duct is directly connected to a drain disposed near the laundry treatment apparatus, there may be a problem in that it is difficult to introduce wash water discharged from a drainage duct of the apparatus into the drain.

In order to solve such problems, a device for connecting the exhaust duct to the drainage duct in order to discharge, into the drain through the drainage duct, air and condensed water as well as wash water, has been proposed.

In this case, smooth exhaust of air may be impossible when a water trap is formed at a portion of the drainage duct downstream of a connection point between the drainage duct and the exhaust duct. Then, there may be a problem in that the humidity of air present in the outer tub is increased and, as such, drying of laundry may be inefficiently carried out.

In particular, in certain areas including North America, drains are typically positioned at certain heights over the floor. For this reason, a U-shaped water trap may be easily formed at the drainage duct. In order to apply the above-mentioned product to North America or the like, accordingly, the above-mentioned problem should be resolved.

PRIOR ART LITERATURE

Patent Document

Korean Unexamined Patent Publication No. 20150026548A

DISCLOSURE OF INVENTION

Technical Problem

Therefore, the present invention has been made in view of the above problems, and it is an object of the present invention to enhance drying efficiency while reducing consumption of energy and cooling water required to dry laundry.

It is another object of the present invention to easily control exhaust and circulation of air during drying of laundry.

It is another object of the present invention to connect an exhaust duct to a drainage duct while achieving smooth exhaust of air even when a water trap is formed in the drainage duct.

It is still another object of the present invention to avoid generation of dew around a laundry treatment apparatus due to air exhausted during drying of laundry.

Objects of the present invention are not limited to the above-described objects, and other objects of the present invention not yet described will be more clearly understood by those skilled in the art from the following detailed description.

Solution to Problem

In accordance with an aspect of the present invention, the above and other objects can be accomplished by the provision of a laundry treatment apparatus including a casing, an outer tub disposed within the casing, to store wash water, an inner tub disposed within the outer tub, to receive laundry, a drainage duct for guiding wash water stored in the outer tub to be discharged to the outside of the casing, a circulation duct for guiding a portion of air present in the outer tub to be re-supplied to the outer tub after being discharged from the outer tub, a fan provided at the circulation duct, to circulate air present in the outer tub, and a heater for heating air introduced into the outer tub The laundry treatment apparatus may further include a first exhaust duct and a second exhaust duct.

The first exhaust duct may be connected, at one end thereof, to the drainage duct, to guide the remaining portion of the air present in the outer tub into the drainage duct.

The second exhaust duct may be upwardly branched from the drainage duct, to exhaust air present in the drainage duct to the outside of the outer tub or the outside of the cashing. The second exhaust duct may guide condensed water produced therein into the drainage duct. The second exhaust duct may be branched at a point downstream of a connection point between the drainage duct and the first exhaust duct.

The drainage duct may be disposed at a branch point of the second exhaust duct, to guide wash water to flow downwards.

The second exhaust duct may be disposed outside the casing.

The second exhaust duct may include a protrusion provided at an inner surface of the second exhaust duct, to increase a contact area of the second exhaust duct contacting air present therein. In an embodiment, the second exhaust duct may have a corrugated inner surface.

The second exhaust duct may include a flow resistor for reducing a flow rate of air in the second exhaust duct. In an embodiment, the second exhaust duct may include a mesh disposed in the second exhaust duct across the second exhaust duct such that air present in the second exhaust duct passes through the mesh.

The second exhaust duct may include a heat transfer portion for discharging, at a downstream portion of the second exhaust duct, heat absorbed through heat exchange of an upstream portion of the second exhaust duct with air passing through the upstream portion of the second exhaust duct. In an embodiment, the heat transfer portion may be arranged along the second exhaust duct, and may include a heat pipe being maintained at a reduced pressure and containing a refrigerant.

The second exhaust duct may include a corrugated tube or a spirally corrugated tube.

The heat pipe may extend spirally along the second exhaust duct. The heat pipe may be arranged along an outwardly protruding portion of the spirally corrugated tube. The heat pipe may be arranged along an inwardly protruding portion of the spirally corrugated tube.

Detailed matters of other embodiments may be apparent from the following description and the accompanying drawings.

Advantageous Effects of Invention

When it is desired to exhaust air through the drainage duct in the laundry treatment apparatus, which is equipped with the hybrid system, normal air exhaust is achieved even when a water trap is formed in the drainage duct, through the above-described technical solution according to the present invention. Accordingly, it may be possible to continuously obtain effects of reducing energy consumption and cooling water required to dry laundry. In addition, it may be possible to reduce a side effect of reducing laundry drying efficiency.

In addition, it may be possible to achieve smooth flow of drained wash water by extending the second exhaust duct upwards while extending the drainage duct downwards in accordance with the present invention.

In addition, it may be possible to maximize utility of the inner space of the casing by arranging the second exhaust duct outside the casing in accordance with the present invention.

In addition, it may be possible to suppress formation of dew around the apparatus by delaying the time taken for moisture contained in exhaust air to be condensed before exhaust of the air, and increasing the contact area, using the protrusions or flow resistor.

In addition, it may be possible to achieve an enhancement in condensation performance by increasing the efficiency of transferring heat from a high-temperature portion of the contact surface exchanging heat with exhaust air to a low-temperature portion of the contact surface, through the heat transfer portion according to the present invention.

Effects of the present invention are not limited to the above-described effects. Other effects not yet described may be clearly understood by those skilled in the art from the accompanying claims.

BRIEF DESCRIPTION OF DRAWINGS

The above and other objects, features and other advantages of the present invention will be more clearly understood from the following detailed description taken in conjunction with the accompanying drawings, in which:

FIG. 1 is a perspective view illustrating a laundry treatment apparatus according to an embodiment of the present invention in a state in which a casing is eliminated;

FIG. 2 is a sectional view conceptually depicting various ducts and flow directions of wash water and air in the laundry treatment apparatus according to the present invention;

FIG. 3 is a vertical sectional view of a drainage duct and a second exhaust duct illustrated in a portion A of FIG. 2, depicting flow directions of wash water and air; and FIG. 4 is a cross-sectional view taken along line F-F' of FIG. 3 and viewed from the top side.

BEST MODE FOR CARRYING OUT THE INVENTION

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

A laundry treatment apparatus according to an embodiment of the present invention is a washing machine including a drying system, which has a drying function. In the following description, the drying system will be described in conjunction with, for example, a hybrid drying system for circulating a portion of air present in an outer tub while exhausting the remaining portion of the air, but is not limited thereto.

In the following description, the laundry treatment apparatus according to the illustrated embodiment of the present invention will be described in conjunction with a front loading type washing machine equipped with a drying system, with reference to FIG. 1. FIG. 1 is a perspective view illustrating the laundry treatment apparatus according to the illustrated embodiment of the present invention in a state in which a casing is eliminated.

The washing machine includes a casing 1 defining an appearance of the washing machine. The washing machine further includes an outer tub 2 disposed within the casing 1, to store wash water. The washing machine also includes an inner tub 3 rotatably disposed within the outer tub 2, to receive laundry and wash water. The washing machine further includes a drainage duct 6 for guiding wash water stored in the outer tub 2 to be discharged to the outside of the casing 1.

In addition, the washing machine includes a circulation duct 7 communicating with the outer tub 2, to guide air present in the outer tub 2 to be re-supplied to the outer tub 2 after being discharged from the outer tub 2. The air guided by the circulation duct 7 may be a portion of air present in the outer tub 2. The washing machine also includes a fan 71 disposed at the circulation duct 7, to circulate air present in the outer tub 2 along the circulation duct 7. The washing machine further includes a heater 73 for heating air introduced into the outer tub 2. The washing machine further includes an air suction duct 8 for guiding air present outside the outer tub 2 or casing 1 to the interior of the outer tub 2.

In addition, the washing machine includes a first exhaust duct 91 connected, at one end thereof, to the drainage duct 6, to guide air present in the outer tub 2 into the drainage duct 6. Air guided by the first exhaust duct 91 may be a portion of air present in the outer tub 2, except for the remaining portion of the air guided by the circulation duct 7. The washing machine further includes a second exhaust duct 92 upwardly branched from the drainage duct 6, to exhaust air present in the drainage duct 6 to the outside of the outer tub 2 or cashing 1. The second exhaust duct 92 guides condensed water produced therein such that the condensed water flows downwards, and then enters a drainage duct 6*d*. The second exhaust duct 92 is branched at a point downstream of a connection point between the drainage duct 6 and the first exhaust duct 91.

In addition, the washing machine includes a water supplier 4 for supplying water to the interior of the outer tub 2. The drainage duct 6, which is included in the washing machine, guides wash water present in the outer tub 2 to be drained.

The casing 1 includes a front panel 11 defining a front wall of the washing machine. The front panel 11 is provided with a laundry entrance for loading laundry into the inner tub 3 or unloading the loaded laundry from the inner tub 3. The laundry entrance 13 is opened or closed by a door 14 rotatably coupled to the casing 1.

A control panel 17 as a user interface is also provided at the front panel 11. The control panel 17 is a means for enabling the user to exchange information with a controller (not shown) of the washing machine.

The control panel 17 is also provided with a power input unit for allowing the user to input a power supply command to the washing machine, and an input unit (not shown) for allowing the user to select a laundry treatment method that can be implemented by the washing machine. The laundry treatment method includes a method for performing a control operation to supply moisture or air to laundry. The control panel 17 may also be provided with a display (not shown) for displaying information as to the laundry treatment method selected by the user or an operation procedure of the washing machine.

The outer tub 2 has a cylindrical shape, and is fixed to the casing 1 within the casing 1 by outer tub supporters 21. An outer tub entrance (nor shown) communicating with the laundry entrance 13 is provided at a front wall of the outer tub 2.

A gasket 23 is provided between the outer tub entrance and the laundry entrance 13. The gasket 23 prevents vibration generated at the outer tub 2 from being transferred to the casing 1. The gasket 23 also prevents leakage of wash water stored in the outer tub 2. The gasket 23 may be made of an elastic material such as rubber.

The inner tub 3 is disposed within the outer tub 2 while being rotatable by a driver (not shown) provided at a rear wall of the outer tub 2. The inner tub 3 is provided with an inner tub entrance communicating with the outer tub entrance. Through holes 33 are formed through a circumferential wall of the inner tub 3.

The circulation duct 7 guides a portion of air present in the outer tub 2 to be resupplied to the outer tub 2 after being discharged from the outer tub 2. The circulation duct 7 may be provided at an upper portion of a circumferential wall of the outer tub 2.

A communication portion (not shown) may be formed at the outer tub 2 in order to enable communication between the outer tub 2 and the circulation duct 7. The communication portion includes a first communication hole (not shown) for guiding air present in the outer tub 2 to the circulation duct 7, and a second communication hole (not shown) to guide air introduced into the circulation duct 7 to the outer tub 2.

The second communication hole may be formed at the gasket 23. That is, a hole may be formed through the gasket 23, and the circulation duct 7 may be connected to the hole. When the second communication hole is provided at the gasket 23, it may be possible to supply heated air to a central portion of the inner tub 3 through the laundry entrance 13 and, as such, efficiency of heat exchange between laundry and air may be enhanced.

The fan 71, which is provided at the circulation duct 7, forces air present in the outer tub 2 to be introduced into the circulation duct 7, and then forces the air introduced into the circulation duct 7 to flow to the second communication hole. The heater 73 heats air flowing through the circulation duct 7 by the fan 71.

The air suction duct 8 may be directly connected to the outer tub 2, or may be connected to a flow path of the circulation duct 7. When the air suction duct 8 is connected to the flow path of the circulation duct 7, the fan 71 may be disposed at a point downstream of a connection point between the circulation duct 7 and the air suction duct 8. In this case, it may be possible to introduce air present outside the outer tub 2 or casing 1 into the circulation duct 7, only using the fan 71 provided at the circulation duct 7, without providing an additory fan at the air suction duct 8.

When an inlet of the air suction duct 8 is disposed inside the casing 1, air present in a space between the casing 1 and the outer tub 2 is introduced into the outer tub 2. On the other hand, when the inlet of the air suction duct 8 is disposed outside the casing 1, air present outside the casing 1 is introduced into the outer tub 2.

The air suction duct 8 may be always maintained in an opened state without using an additory means for controlling opening/closing of the air suction duct 8.

The air suction duct 8 may include a section extending upwards by a predetermined length. By virtue of this section, it may be possible to prevent foam produced by a detergent during washing from being discharged from the casing 1 through the air suction duct 8.

A filter (not shown) for filtering air introduced from the outside may be provided at the air suction duct 8 or circulation duct 7.

The circulation duct 7 may be supported by the outer tub 2. The air suction duct 8 may be supported by the outer tub 2 and/or the circulation duct 7. In this case, the circulation duct 7 and the outer tub 2 may vibrate at substantially the same frequency and, as such, it may be possible to reduce the possibility that the air suction duct 8 is broken by vibration, even when the air suction duct 8 is in contact with both the outer tub 2 and the circulation duct 7.

The water supplier 4 includes a water supply line 43 for guiding water from a water supply source (not shown) disposed outside the casing 1 to the detergent supplier 5, and a water supply valve 41 for opening or closing the water supply line 43.

The detergent supplier 5 includes a detergent storage (not shown) for storing a detergent, and a detergent supply pipe 55 for guiding water containing the detergent from the detergent storage to the interior of the outer tub 2. The detergent storage may be provided to be ejectable from the front panel 11.

The drainage duct 6 guides wash water present in the outer tub 2 to be discharged from the casing 1. A drainage pump 63 may be provided at the drainage duct 6, to drain wash water. The drainage pump 63 may be disposed at an upstream portion of the drainage duct 6. The drainage pump 63 may also be disposed at a level lower than that of wash water in the outer tub 2.

The drainage duct 6 includes a first section 6*a* that guides wash water from the outer tub 2 to the drainage pump 63, a second section 6*b* that guides wash water from the drainage pump 63 to a connection point between the drainage duct 6 and the first exhaust duct 91, a third section 6*c* that guides wash water from the connection point between the drainage duct 6 and the first exhaust duct 91 to a branch point of the second exhaust duct 92, and a fourth section 6*d* that guides wash water from the branch point of the second exhaust duct 92 to the outside of the casing 1. The branch point of the second exhaust duct 92 means a connection point between the second exhaust duct 92 and the drainage duct 6.

A flow path switch 65 is provided at the connection point between the drainage duct 6 and the first exhaust duct 91, to control opening and closing of the drainage duct 6 and first exhaust duct 91. The flow path switch 65 may prevent air exhausted through the first exhaust duct 91 from being introduced backwards into the outer tub 2. The flow path switch 65 may also prevent wash water drained through the drainage duct 6 from being introduced backwards into the outer tub 2.

The flow path switch 65 may be disposed at a level higher than a predetermined maximum water level of the outer tub 2. In this case, a water trap may be formed at the first and second sections 6*a* and 6*b* of the drainage duct 6 and, as such, it may be possible to prevent air from being introduced into the first and second sections 6*a* and 6*b*.

The fourth section 6*d* of the drainage duct 6 extends downwards from the branch point of the second exhaust duct 92, to guide wash water to flow downwards. In this case, accordingly, wash water flowing through the third section 6*c* of the drainage duct 6 may be easily introduced into the fourth section 6*d* of the drainage duct 6.

The first exhaust duct 91 guides a portion of air present in the outer tub 2 such that the guided air is introduced into the drainage duct 6. The first exhaust duct 91 is connected, at one end thereof, to the flow path switch 65. Accordingly, exhaust air flows along the third section 6*c* of the drainage duct 6.

The first exhaust duct 91 may be connected, at the other end thereof, to the circulation duct 7, to exhaust a portion of air introduced into the circulation duct 7. In the illustrated embodiment, however, the other end of the first exhaust duct 91 is directly connected to the outer tub 2. In addition, the first exhaust duct 91 may be connected to any position of the outer tub 2. In the illustrated embodiment, however, the first exhaust duct 91 is connected to the upper portion of the circumferential wall of the outer tub 2.

The second exhaust duct 92 exhausts air present in the third section 6*c* of the drainage duct 6 to the outside of the outer tub 2 or casing 1. That is, when the outlet of the second exhaust duct 92 is disposed inside the casing 1, air is exhausted to a space between the casing 1 and the outer tub 2. On the other hand, when the outlet of the second exhaust duct 92 is disposed outside the casing 1, air is exhausted to the outside of the casing 1.

The second exhaust duct 92 is branched upwards from the drainage duct 6. Accordingly, air flowing through the third section 6*c* of the drainage duct 6 may be easily introduced into the second exhaust duct 92.

The second exhaust duct 92 guides condensed water produced therein to be introduced into the fourth section 6*d* of the drainage duct 6. That is, moisture contained in air flowing through the second exhaust duct 92 is condensed while passing through the second exhaust duct 92. In order to discharge such condensed water, an additory duct may be provided. In the illustrated embodiment, however, condensed water flows backwards along an inner surface of the second exhaust duct 92, and is then introduced into the fourth section 6*d* of the drainage duct 6 after flowing to the branch point of the second exhaust duct 92. The condensed water introduced into the fourth section 6*d* of the drainage duct 6 is drained to the outside of the casing 1, together with wash water.

The second exhaust duct 92 is branched at a point downstream of the connection point between the drainage duct 6 and the first exhaust duct 91. Air flowing through the third section 6*c* of the drainage duct 6 is separated from wash water at the branch point of the second exhaust duct 92, and is then introduced into the second exhaust duct 92.

FIG. 2 is a sectional view conceptually depicting various ducts and flow directions of wash water and air in the laundry treatment apparatus according to the present invention.

In FIG. 2, the direction of an arrow B is a circulation direction of air. During operation of the fan 71, air is partially moved from the interior of the outer tub 2 maintained in a positive pressure state to the circulation duct 7 maintained in a negative pressure state through the first communication hole. Air moved to the circulation duct 7 is heated while passing around the heater 73, is then re-supplied to the interior of the outer tub 2.

The direction of an arrow C is an introduction direction of outside air. During operation of the fan 71, air is introduced from the outside of the outer tub 2 or casing 1 maintained in an atmospheric pressure state to the circulation duct 7 maintained in a negative pressure state. Air introduced into the circulation duct 7 is heated while passing around the heater 73, is then re-supplied to the interior of the outer tub 2.

The direction of an arrow D is an exhaust direction of air. During operation of the fan 71, air is introduced from the interior of the outer tub 2 maintained in a positive pressure state to the drainage duct section 6*c* along the first exhaust duct 91. Air introduced into the drainage duct section 6*c* is exhausted to the outside of the outer tub 2 or casing 1.

The direction of an arrow E is a drainage direction of wash water. During operation of the drainage pump 63, wash water present in the outer tub 2 is drained to the outside of the casing 1 after sequentially passing through the first section 6*a*, second section 6*b*, third section 6*c* and fourth section 6*d* of the drainage duct 6. In detail, wash water present in the outer tub 2 is moved to the flow path switch 65 via the first section 6*a* and second section 6*b* of the drainage duct 6. The wash water introduced into the flow path switch 65 is moved along the third section 6*c* of the drainage duct 6, together with air introduced through the first exhaust duct 91. The wash water flowing along the third section 6*c* of the drainage duct 6 is drained to the outside of the casing 1 through the fourth section 6*d* of the drainage duct 6.

FIG. 3 is a vertical sectional view of the drainage duct 6 and second exhaust duct 92 illustrated in a portion A of FIG. 2, depicting flow directions of wash water and air.

Wash water flowing through the third section 6*c* of the drainage duct 6 (in the arrow direction E) is drained to the outside of the casing 1 along the fourth section 6*d* of the drainage duct 6, together with condensed water produced in accordance with condensation of moisture contained in exhaust air (in an arrow direction G).

Air flowing through the third section 6*c* of the drainage duct 6 (in the arrow direction D) may be exhausted along the fourth section 6*d* of the drainage duct 6 or the second exhaust duct 92. In this case, air may be exhausted to the outside of the outer tub 2 or casing 1 through the second exhaust duct 92 (in an arrow direction H), even when a water trap I is formed at the fourth section 6*d* of the drainage duct 6.

The second exhaust duct 92 is branched upwards from the drainage duct 6. The fourth section 6*d* of the drainage duct 6 extends downwards from the branch point of the second exhaust duct 92. Since liquid may naturally flow downwards by gravity, and gas may naturally move upwards, it may be possible to easily achieve discharge of liquid and gas in the above-described directions (in the arrow directions G and H), respectively, after separation.

The second exhaust duct 92 may be disposed inside the casing 1. In the illustrated embodiment, however, the second exhaust duct 92 is disposed outside the casing 1. That is, the second exhaust duct 92 is branched from a portion of the drainage duct 6 exposed outside the casing 1. In this case, there is an advantage in terms of utility of the inner space of the casing 1.

Air passing through the second exhaust duct 92, which has a high temperature, exchanges heat with the second exhaust duct 92, which has a relatively low temperature. When heat exchange is more actively carried out, moisture contained in air passing through the exhaust duct 92 is more easily condensed. An additory system or device for cooling the second exhaust duct 92 may be provided.

The material of the second exhaust duct 92 may be selected from various materials such as aluminum and synthetic resin.

The second exhaust duct 92 may include a protrusion (not shown) provided at an inner surface of the second exhaust duct 92, to increase a contact area of the second exhaust duct 92 contacting air present in the second exhaust duct 92. When heat exchange of air exchanging heat with the second exhaust duct 92 while passing through the second exhaust duct 92 is more actively carried out, moisture contained in the air is more easily condensed. To this end, the contact area of the inner surface of the second exhaust duct 92 is increased.

The protrusion may have a lug, bump or plate shape protruding from the inner surface of the second exhaust duct 92. The protrusion may have a bar or net shape extending across the second exhaust duct 92 such that the protrusion has two or more coupling points with the inner surface of the second exhaust duct 92. A plurality of protrusions may be formed on a predetermined cross-sectional portion of the second exhaust duct 92. The protrusion may have various shapes and arrangements.

In the illustrated embodiment, the inner surface of the second exhaust duct 92 has a corrugated shape. Protruded portions 921 of the corrugated inner surface function as the above-described protrusion. For example, the second exhaust duct 92 may include a corrugated tube.

Corrugations of the second exhaust duct 92 may be formed in accordance with extension of a plurality of circular protrusions and a plurality of circular grooves along the circumference of the second exhaust duct 92 in an alternating manner. In the illustrated embodiment of the present invention, however, protrusions and grooves extend spirally along the circumference of the second exhaust duct 92 in an alternating manner. The second exhaust duct 92 may include a spirally corrugated tube.

The second exhaust duct 92 may include flow resistor (not shown) for reducing the flow rate of exhaust air passing through the second exhaust duct 92. The protrusions may function as the flow resistor. In this case, air passing through the second exhaust duct 92 is subjected to resistance by the protrusions protruding from the inner surface of the second exhaust duct 92.

The flow resistor may be formed by narrowing or bending a portion of the second exhaust duct 92. Otherwise, it may be possible to increase flow resistance by increasing the length of the second exhaust duct 92.

As the flow resistance is increased by the flow resistor, condensation of moisture contained in exhaust air is enhanced. In this case, however, increased load is applied to the fan 71 in order to exhaust the same amount of air. Accordingly, the level of flow resistance may be set to an appropriate level through adjustment of the kind, size, length, arrangement, and number of flow resistors.

For example, it may be possible to enhance a function of removing moisture from air by delaying the time taken for exhaust air to pass through the second exhaust duct 92 in accordance with an increase in the length of the second exhaust duct 92. However, when the length of the second exhaust duct 92 increases, the flow resistance of exhaust air is increased and, as such, it is necessary to operate the fan at a higher pressure even when the same amount of air is exhausted. Accordingly, the length of the second exhaust duct 92 may be determined, taking into consideration an appropriate load of the fan and a desired condensation performance.

FIG. 4 is a cross-sectional view taken along line F-F' of FIG. 3 and viewed from the top side. In the illustrated embodiment, the second exhaust duct 92 includes a mesh 923 arranged transversally in the second exhaust duct 92. Air flowing in the second exhaust duct 92 passes through the mesh 923. As a result, the flow resistance of air exhausted through the second exhaust duct 92 is increased. The pore size of the mesh may be set in accordance with a desired level of flow resistance.

The mesh 923 may also function to increase the contact area of the second exhaust duct 92 contacting air passing therethrough.

The second exhaust duct 92 may include a heat transfer portion (not shown) for rapidly transferring heat from an upstream portion of the second exhaust duct 92 to a downstream portion of the second exhaust duct 92 such that heat absorbed through heat exchange of the upstream portion of the second exhaust duct 92 with air passing through the upstream portion of the second exhaust duct 92 is discharged at the downstream portion of the second exhaust duct 92 through heat exchange of the downstream portion of the second exhaust duct 92 with air passing through the downstream portion of the second exhaust duct 92.

Air passing through the upstream portion of the second exhaust duct 92 has a higher temperature than air passing through the downstream portion of the second exhaust duct 92. This is because the second exhaust duct 92 absorbs heat from air passing therethrough and, as such, the temperature of the air is reduced while flowing through the second exhaust duct 92. Meanwhile, when the upstream portion of the second exhaust duct 92 continuously receives heat, the temperature thereof is increased and, as such, it may be impossible to achieve efficient heat exchange of the second exhaust duct 92 with air passing through the upstream portion of the second exhaust duct 92. As a result, the condensation performance of the apparatus may be reduced. Accordingly, when the heat transfer portion rapidly transfers heat from the upstream portion of the second exhaust duct 92 to the downstream portion of the second exhaust duct 92, it may be possible to reduce the temperature of the upstream portion of the second exhaust duct 92 and, as such, a desired condensation performance may be secured even at the upstream portion of the second exhaust duct 92.

The heat transfer portion may be arranged along the second exhaust duct 92. In this case, it is shown that heat absorption degree at each portion of the heat transfer portion is gradually reduced from the upstream portion of the second exhaust duct 92 toward "a middle portion" of the second exhaust duct 92. In addition, it is shown that heat discharge degree at each portion of the heat transfer portion is gradually increased from the "middle portion" of the second exhaust duct 92 toward the downstream portion of the second exhaust duct 92. The middle portion means a portion of the second exhaust duct 92 disposed between the upstream and down stream portions while having no function of absorbing or discharging heat.

The heat transfer portion may include a heat pipe 925 maintained at a reduced pressure. And, the heat pipe 925 contains a refrigerant. The heat pipe 925 has a tubular shape, and has a sealed inner space containing a refrigerant. The inner space of the heat pipe 925 has a reduced pressure. In this case, the pressure reduction level may be varied in accordance with a predetermined vaporization point (or the liquefaction point) of the refrigerant.

The heat pipe 925 may be arranged along the second exhaust duct 92. The heat pipe 925 may extend spirally along the second exhaust duct 92. Referring to FIG. 4, the heat pipe 925 may extend spirally along an outwardly protruding portion of the spirally corrugated tube in the illustrated embodiment. In another embodiment, the heat pipe 925 may extend spirally along an inwardly protruding portion of the spirally corrugated tube. When the spirally corrugated tube has a plurality of spirally protruding portions, the heat pipe 925 may have a plurality of threads. When the heat pipe 925 is arranged along the protruding portion of the spirally corrugated tube, the outer profile of the corrugated tube may be firmly maintained even when the corrugated tube is made of a flexible material.

Hereinafter, the function of the heat pipe 925 will be described. The refrigerant contained in the heat pipe 925 absorbs vaporization heat from the upstream portion of the second exhaust duct 92 and, as such, is vaporized. The vaporized refrigerant is moved to the downstream portion of the second exhaust duct 92, and is liquefied while discharging liquefaction heat therefrom. The liquefied refrigerant is again moved to the upstream portion of the second exhaust duct 92 along the inner space of the heat pipe 925. Thus, it may be possible to transfer heat from the upstream portion of the second exhaust duct 92 to the downstream portion of the second exhaust duct 92 at a high speed, using vaporization heat and liquefaction heat of the refrigerant.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A laundry treatment apparatus comprising:

a casing;

an outer tub disposed within the casing, to store wash water;

an inner tub disposed within the outer tub, to receive laundry;

a drainage duct for guiding wash water stored in the outer tub to be discharged to the outside of the casing;

a first exhaust duct connected, at one end thereof, to the drainage duct, to guide air present in the outer tub into the drainage duct; and a second exhaust duct upwardly branched from the drainage duct, to exhaust air present in the drainage duct to the outside of the outer tub or the outside of the casing, wherein the second exhaust duct is branched at a point downstream a connection point between the drainage duct and the first exhaust duct, and wherein the drainage duct is extended at the branched point of the second exhaust duct to the outside of the outer tub or the casing, in order to guide wash water in the drainage duct and condensed water in the second exhaust duct to be drained outside of the outer tub or the casing.

2. The laundry treatment apparatus according to claim 1, further comprising:

a circulation duct for guiding a portion of air present in the outer tub to be re-supplied to the outer tub after being discharged from the outer tub.

3. The laundry treatment apparatus according to claim 2, further comprising:

a fan provided at the circulation duct, to circulate air present in the outer tub.

4. The laundry treatment apparatus according to claim 1, further comprising:

a heater for heating air introduced into the outer tub.

5. The laundry treatment apparatus according to claim 1, wherein the second exhaust duct is disposed outside the casing.

6. The laundry treatment apparatus according to claim 1, wherein the second exhaust duct comprises a protrusion provided at an inner surface of the second exhaust duct, to increase a contact area of the second exhaust duct contacting air present therein.

7. The laundry treatment apparatus according to claim 1, wherein the second exhaust duct has a corrugated inner surface.

8. The laundry treatment apparatus according to claim 1, wherein the second exhaust duct comprises a flow resistor for reducing a flow rate of air in the second exhaust duct.

9. The laundry treatment apparatus according to claim 1, wherein the second exhaust duct comprises a mesh disposed in the second exhaust duct across the second exhaust duct such that air present in the second exhaust duct passes through the mesh.

10. The laundry treatment apparatus according to claim 1, wherein the second exhaust duct comprises a heat transfer portion for discharging, at a downstream portion of the second exhaust duct, heat absorbed through heat exchange of an upstream portion of the second exhaust duct with air passing through the upstream portion of the second exhaust duct.

11. The laundry treatment apparatus according to claim 10, wherein the heat transfer portion is arranged along the second exhaust duct.

12. The laundry treatment apparatus according to claim 10, wherein the heat transfer portion comprises a heat pipe being maintained at a reduced pressure and containing a refrigerant.

13. The laundry treatment apparatus according to claim 12, wherein the heat pipe extends spirally along the second exhaust duct.

14. The laundry treatment apparatus according to claim 13, wherein:

the second exhaust duct comprises a spirally corrugated tube; and the heat pipe is arranged along an outwardly protruding portion of the spirally corrugated tube.

15. The laundry treatment apparatus according to claim 13, wherein:

the second exhaust duct comprises a spirally corrugated tube; and the heat pipe is arranged along an inwardly protruding portion of the spirally corrugated tube.

16. The laundry treatment apparatus according to claim 1, wherein the second exhaust duct comprises a corrugated tube.

17. The laundry treatment apparatus according to claim 1, wherein the second exhaust duct comprises a spirally corrugated tube.

* * * * *